US007618103B2

(12) United States Patent
Kim

(10) Patent No.: US 7,618,103 B2
(45) Date of Patent: Nov. 17, 2009

(54) SUPPLEMENTARY SHELF ASSEMBLY FOR REFRIGERATOR

(75) Inventor: Yong Ju Kim, Jeollanam-do (KR)

(73) Assignee: LG Electronics Inc., Seoul (KR)

( * ) Notice: Subject to any disclaimer, the term of this patent is extended or adjusted under 35 U.S.C. 154(b) by 607 days.

(21) Appl. No.: 11/302,427

(22) Filed: Dec. 14, 2005

(65) Prior Publication Data

US 2006/0125362 A1 Jun. 15, 2006

(30) Foreign Application Priority Data

Dec. 15, 2004 (KR) ..... 10-2004-0106663
Dec. 15, 2004 (KR) ..... 10-2004-0106664
Dec. 15, 2004 (KR) ..... 10-2004-0106665

(51) Int. Cl.
*A47B 96/02* (2006.01)

(52) U.S. Cl. ..... 312/408; 108/138

(58) Field of Classification Search ..... 312/401, 312/408, 410, 248, 208.1, 311, 321, 351; 62/382; 211/90.02, 90.03; 108/96, 106, 108/145, 31, 138, 149
See application file for complete search history.

(56) References Cited

U.S. PATENT DOCUMENTS 1,147,998 A * 7/1915 Anderson ..... 312/204
2,599,416 A * 6/1952 Saecker ..... 248/447
2,822,229 A * 2/1958 Carlson ..... 312/27
2,855,262 A * 10/1958 Sharpe ..... 312/325
3,857,623 A * 12/1974 Schneller ..... 312/266
4,098,094 A * 7/1978 Linstromberg ..... 62/344
4,528,825 A * 7/1985 Khan ..... 62/441
4,625,657 A * 12/1986 Little et al. ..... 108/93
5,626,323 A * 5/1997 Lechman et al. ..... 248/286.1
6,997,531 B2 * 2/2006 Kim et al. ..... 312/408
7,316,326 B2 * 1/2008 Kim et al. ..... 211/90.03
2002/0109444 A1 * 8/2002 Webb et al. ..... 312/313
2004/0207305 A1 * 10/2004 Kim et al. ..... 312/408

* cited by examiner

*Primary Examiner*—James O Hansen
(74) *Attorney, Agent, or Firm*—KED & Associates LLP

(57) ABSTRACT

The present invention relates to a supplementary shelf assembly for a refrigerator. The supplementary shelf assembly of the present invention comprises a pair of support skirts mounted on a ceiling of a storage space and formed with at least two guide slots in front and rear ends thereof; at least two support links each of which includes a connection portion having a length relatively shorter than a distance between the support skirts, support guide portions extending perpendicular from both ends of the connection portion, respectively, and penetration portions extending outwardly and in parallel to the connection portions from ends of the support guide portions and penetrating the corresponding guide slots to be moved along the guide slots, respectively; and a supplementary shelf rotatably supported by the connection portions, and moved forward or rearward of the storage space and then elevated or lowered to be selectively located on a position near the ceiling of the storage space or on a position spaced apart by a predetermined interval from the ceiling of the storage space. According to the present invention, since a front and rear length of the supplementary shelf is equal to that of the main shelf, the storage space can be effectively utilized. Further, since the supplementary shelf is inadvertently swung due to a simple structure during its use, the supplementary shelf assembly can be simply manufactured and assembled. Furthermore, since the accommodation and withdrawal of the supplementary shelf is performed in regular manner, the operational reliability thereof can be improved and storage articles can be stably placed on the supplementary shelf.

15 Claims, 8 Drawing Sheets

SUPPLEMENTARY SHELF ASSEMBLY FOR REFRIGERATOR

BACKGROUND OF THE INVENTION

1. Field of Invention

The present invention relates to a refrigerator, and more particularly, to a supplementary shelf assembly for a refrigerator which can be selectively mounted to and used in a storage space of the refrigerator.

2. Description of the Prior Art

Generally, a plurality of shelf assemblies are provided in a storage space of a refrigerator. Storage articles to be stored in the storage space are put on top surfaces of the shelf assemblies. As such, the allowable height of the storage article which may be put on the top surface of each shelf assembly depends on the spacing between the shelf assembly and an upper shelf assembly provided just above the shelf assembly.

Thus, a supplementary shelf assembly mounted to be movable up or down is employed to effectively utilize a storage space between the adjacent shelf assemblies. FIG. 1 shows a conventional supplementary shelf assembly, which is disclosed in Korean Utility Model Application No. 1996-31517.

As shown in this figure, a storage space S is provided in a refrigerator body 1. Support protrusions 3 are provided lengthwise in a fore-and-aft direction along both sides of the storage space S. A main shelf 20 is provided in the storage space S. Both bottom side ends of the main shelf 5 are supported by the support protrusions, respectively. The main shelf 5 has a front and rear length equal to that of the storage space S.

A supplementary shelf 7 is provided within the interior of the storage space S above the main shelf 5. The supplementary shelf 7 is mounted to be movable up or down with respect to the main shelf 5. To this end, the main and supplementary shelves 5 and 7 are connected by means of a plurality of support members 9.

Both ends of the support members 9 are pivotally connected to both sides of the main and supplementary shelves 5 and 7 by means of hinge pins 10, respectively. The rotation of the support members 9 causes the supplementary shelf 7 to be lowered while being moved forward of the storage space S or to be elevated while being moved rearward of the storage space S, with respect to the main shelf 5.

Furthermore, the support member adjacent to a rear surface the storage space S is provided with a locking holder 11. The locking holder 11 may be selectively fastened to a locking protrusion 13 installed on the rear surface of the storage space S. The selective fastening between the locking holder and protrusion 11 and 13 causes the supplementary shelf 7 to be kept at or movable down from a state where the supplementary shelf 7 is elevated with respect to the main shelf 5.

That is, in a case where both the main shelf 5 and the supplementary shelf 7 are used, the supplementary shelf 7 is positioned above the main shelf 5 while being moved rearward in the storage space S and elevated with respect to the main shelf 5. At this time, the locking holder 11 and the locking protrusion 13 are fastened to each other, and thus, the supplementary shelf 7 is kept at its elevated position above the main shelf 5 corresponding to a length of the support member 9. In a case where the supplementary shelf 7 needs not be used, the locking holder 11 is unfastened from the locking protrusion 13, so that the supplementary shelf 7 is securely seated on a top surface of the main shelf 5 while being moved forward in the storage space S and lowered with respect to the main shelf 5.

However, there are the following problems in the prior art so configured.

As described above, the supplementary shelf 7 is elevated or lowered with respect to the main shelf 5 while being moved rearward or forward in the storage space S. Thus, there is a problem in that the storage area of the supplementary shelf on which storage articles are placed can be reduced, because the supplementary shelf 7 has a front and rear length that is relatively shorter than that of the main shelf 5.

Meanwhile, the supplementary shelf 7 elevated with respect to the main shelf 5 is kept at its elevated position due to the fastening of the locking holder and protrusion 11 and 13. Therefore, there is another problem in that the refrigerator configuration is complicated, because the structure used for maintaining the supplementary shelf 7 at a certain position, i.e. the locking protrusion, should be additionally installed on the rear surface of the storage space S other than the main or supplementary shelf 5 or 7.

Further, both ends of the support member 9 are connected to both sides of the main and supplementary shelves 5 and 7, respectively. Thus, due to the manufacturing tolerance of the support member 9 or assembling tolerance in the process of connecting the support members 9 to the main shelf 5 and/or the supplementary shelf 7, the support members 9 may be incorrectly rotated in response to the up or down motion of the supplementary shelf 7. Therefore, the operational reliability of the supplementary shelf 7 may be lowered.

As describe above, the supplementary shelf 7 are fixed by the fastening of the locking holder and protrusion 11 and 13. Thus, when relatively heavy storage articles are placed on the top surface of the supplementary shelf 7, the fastened locking holder 11 and locking protrusion 13 may be unfastened from each other. As a result, the supplementary shelf 7 may be inadvertently lowered.

SUMMARY OF THE INVENTION

The present invention is conceived to solve the aforementioned problems in the prior art. Accordingly, an object of the present invention is to provide a supplementary shelf assembly for a refrigerator capable of maximizing the quantity of storage articles to be seated thereon.

Another object of the present invention is to provide a supplementary shelf assembly for a refrigerator which can be more easily constructed.

A further object of the present invention is to provide a supplementary shelf assembly for a refrigerator which can have improved operational reliability.

A still further object of the present invention is to provide a supplementary shelf assembly for a refrigerator in which the supplementary shelf can be more firmly kept at an elevated position.

According to an aspect of the present invention for achieving the objects, there is provided a supplementary shelf assembly for a refrigerator, comprising: a pair of support skirts mounted on a ceiling of a storage space and formed with at least two guide slots in front and rear ends thereof; at least two support links each of which includes a connection portion having a length relatively shorter than a distance between the support skirts, support guide portions extending perpendicular from both ends of the connection portion, respectively, and penetration portions extending outwardly and in parallel to the connection portions from ends of the support guide portions and penetrating the corresponding guide slots to be moved along the guide slots, respectively; and a supplementary shelf rotatably supported by the connection portions, and moved forward or rearward of the storage space and then elevated or lowered to be selectively located on a position near the ceiling of the storage space or on a position spaced apart by a predetermined interval from the ceiling of the storage space.

The ceiling of the storage space on which the support skirts are mounted is a bottom surface of a main shelf by which a storage space is divided into upper and lower spaces.

The supplementary shelf is moved forward or rearward with respect to the main shelf by a length of the support guide portion to be accommodated at or withdrawn from a position just below the main shelf between the support skirts in a state where the supplementary shelf is in an elevated state.

Each of the support skirts includes: guide ribs formed lengthwise along upper ends of the guide slots to restrict a rotation range of the support guide portions and also to guide motions of the support guide portions; and support ribs formed lengthwise along lower ends of the guide slots to support the support guide portions and to guide the motions of support guide portions in a state where the supplementary shelf is accommodated at the position just below the main shelf.

A distance between the guide slots is equal to the length of the support guide portion.

Each of the support ribs is formed with a catching projection on a front end thereof to prevent the penetration portion from being moved along the guide slot until the supplementary shelf is elevated and the rotation of the support guide portion is then limited by the guide rib.

Stoppers for restricting the rotation range of the support guide portions are formed on the support skirts at positions in front of the front ends of the guide slots.

Link holders to which the connection portions are rotationally received are formed on the bottom surface of the supplementary shelf, and swing-resistant ribs brought into close contact with both sides of each of the link holders to prevent the supplementary shelf from being swung in a right and left direction are provided on the connection portion.

At least two link holders are provided on each of the connection portions. The link holders are formed at positions near front and rear ends on the bottom surface of the supplementary shelf, and the rear link holders are spaced apart by at least the length of the support guide portion from the front link holders and from the rear end on the bottom surface of the supplementary shelf.

It is prefer, further comprising coupling links having both ends rotatably coupled to the support links to allow the support links to be moved together.

Partially opened rings with insertion holes are formed at both ends of the coupling link, respectively, and the penetration portions penetrate the corresponding guide slots and fitted into the insertion holes rings, respectively, so that the support links and the coupling link can be rotationally connected with each other.

The insertion hole of the ring formed on one end of the coupling link is opened toward the end of the coupling link to be inclined at a predetermined angle with respect to a longitudinal axis of the coupling link, and the insertion hole of the ring formed on the other end of the coupling link is opened downward to be perpendicular to the longitudinal axis of the coupling link.

The predetermined angle is 45 degrees.

A distance between the connection portions connected to the supplementary shelf is relatively shorter than a distance between the insertion hole of the rings of the coupling link.

The supplementary shelf assembly for refrigerator according to the present invention so configured has advantages in that the quantity of storage articles to be placed on the top surface of the supplementary shelf can be maximized, the supplementary shelf assembly can be more easily constructed and have improved operational reliability, and the supplementary shelf can be more firmly kept at its elevated position.

BRIEF DESCRIPTION OF THE DRAWINGS

The above and other objects, features and advantages of the present invention will become apparent from the following description of preferred embodiments given in conjunction with the accompanying drawings, in which.

DETAILED DESCRIPTION OF THE PREFERRED EMBODIMENT

Hereinafter, preferred embodiments of the present invention will be described in detail with reference to the accompanying drawings.

Figure 1:
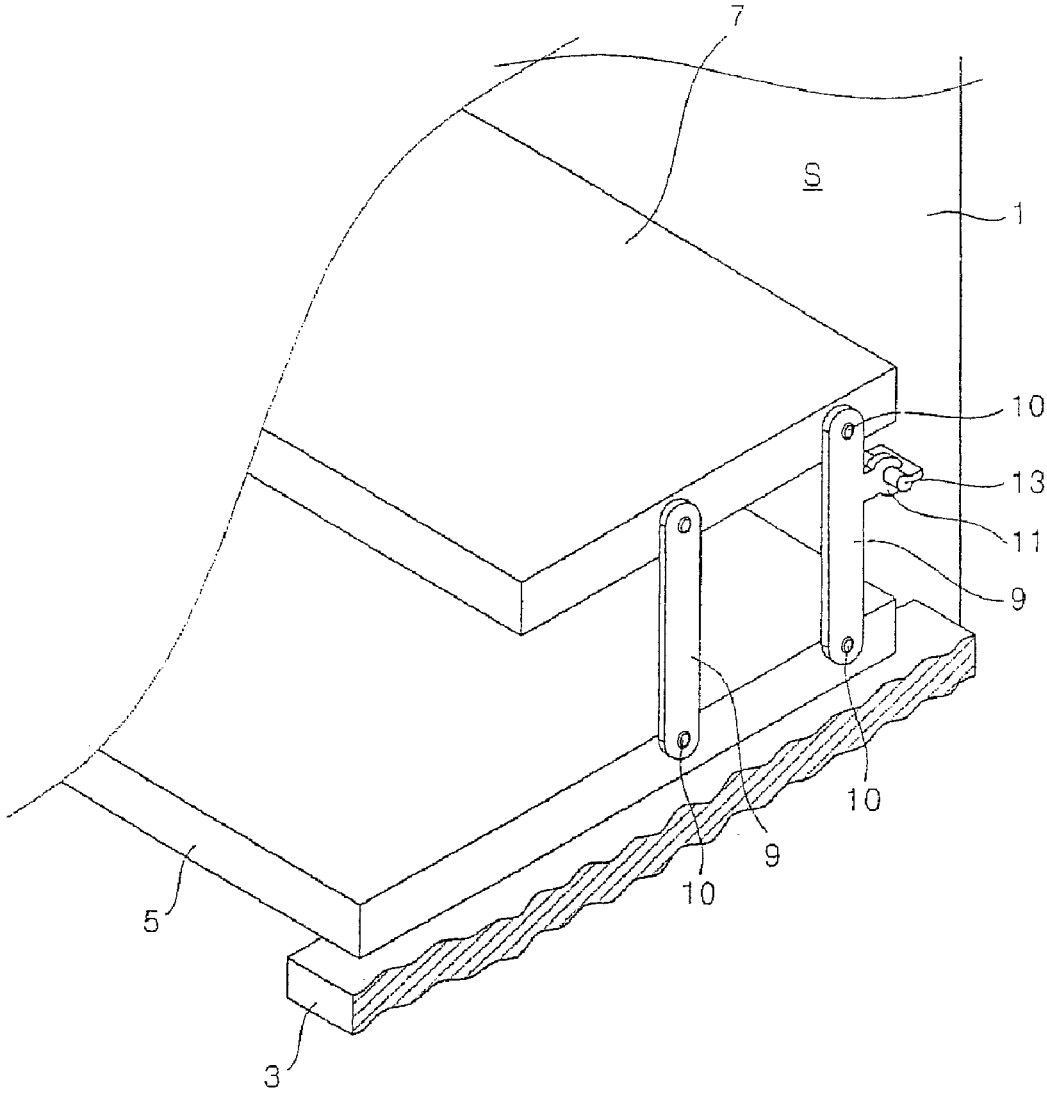
FIG. 1 RELATED ART
FIG. 1 is a schematic perspective view showing the configuration of a conventional supplementary shelf assembly for a refrigerator.
Figure 2:
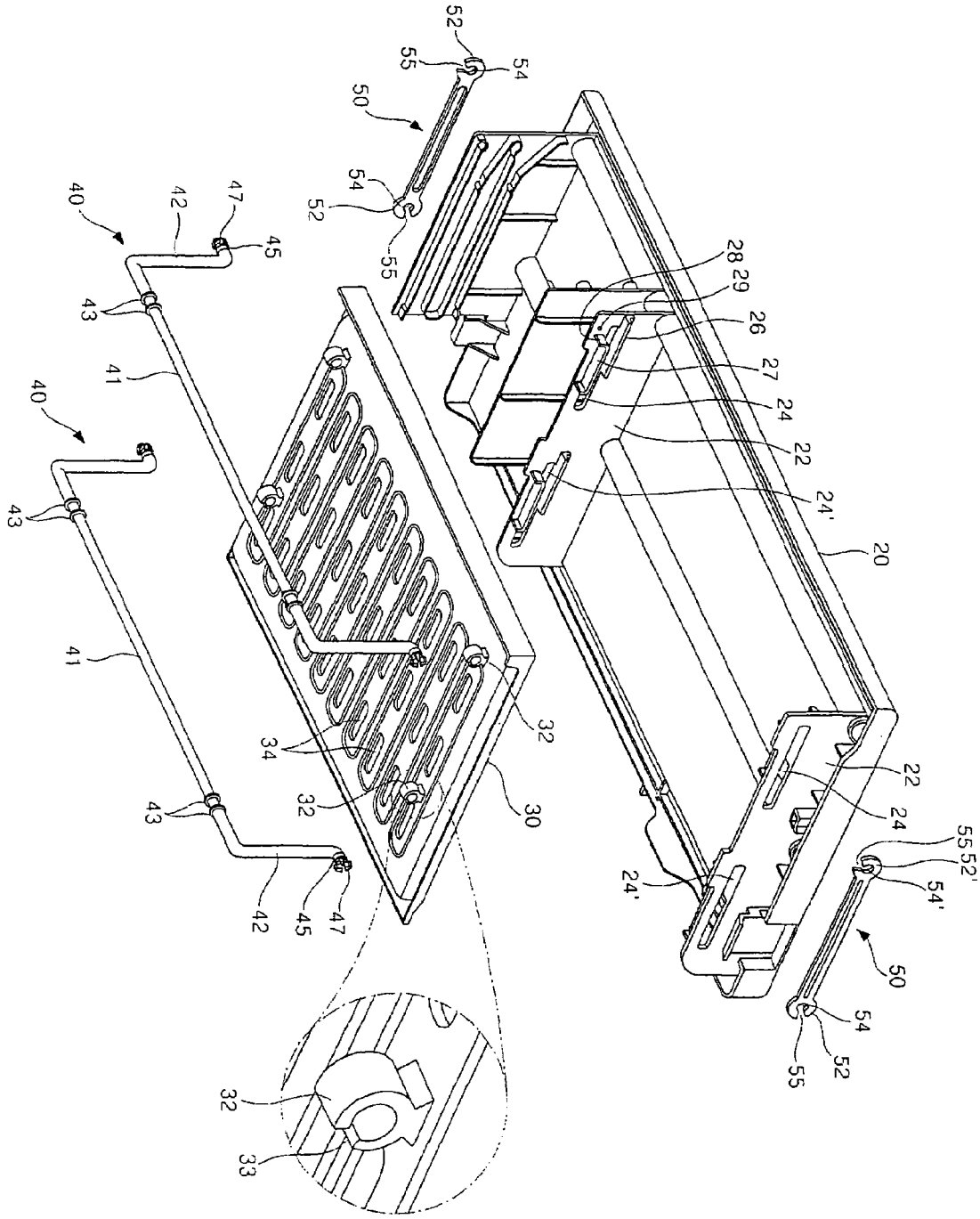
FIG. 2 is an exploded perspective view showing a preferred embodiment of a supplementary shelf assembly for a refrigerator according to the present invention.
Figure 3:
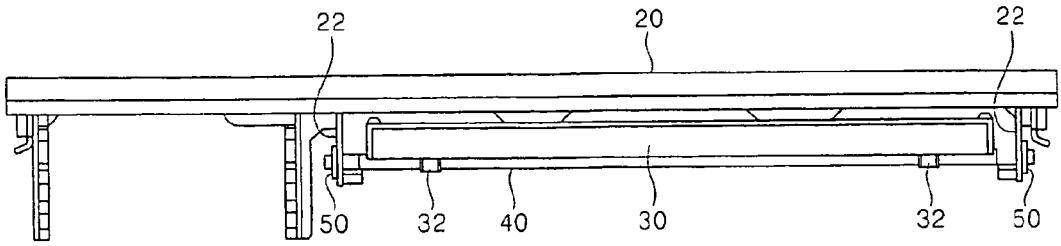
FIG. 3 is a front view of the embodiment shown in FIG. 2.
Figure 4:
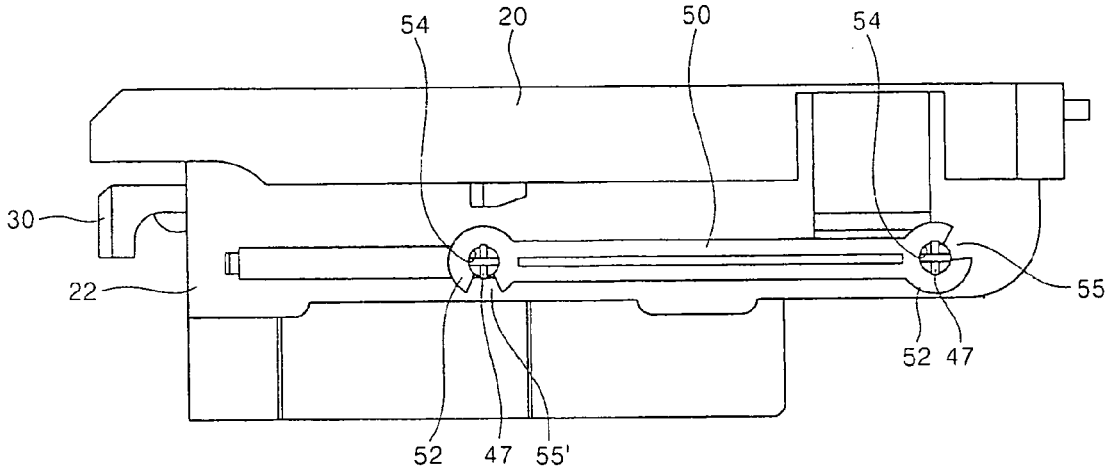
FIG. 4 is a side view of the embodiment shown in FIG. 2.
Figure 5:
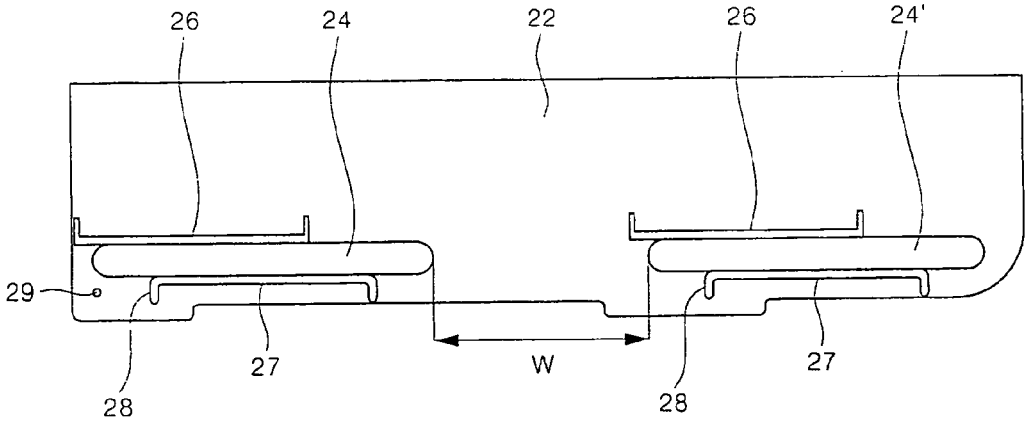
FIG. 5 is a side view showing a support skirt of the embodiment shown in FIG. 2.
Figure 6:
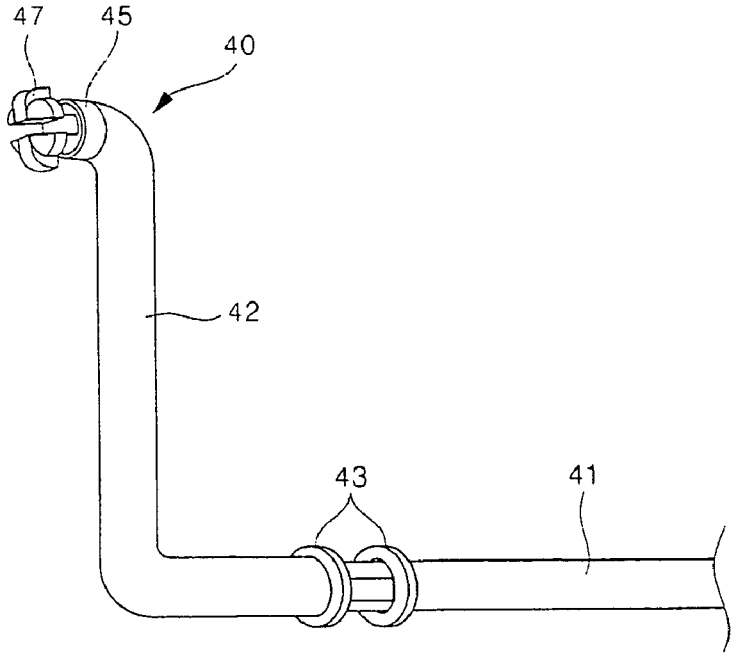
FIG. 6 is a partial perspective view showing a main portion of the Support link of the embodiment shown in FIG. 2.
Figure 7:
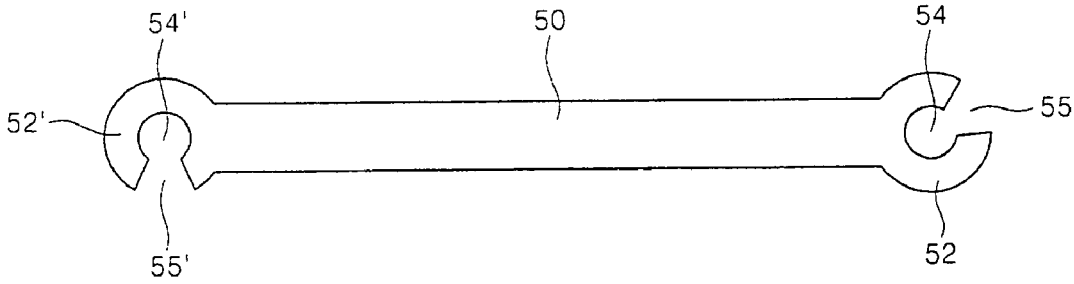
FIG. 7 is a side view showing a coupling link of the embodiment shown in FIG. 2.

FIGS. 2 to 4 show a preferred embodiment of a supplementary shelf assembly for a refrigerator according to the present invention. FIGS. 5 to 7 show a support skirt, a support link and a coupling link, which construct the embodiment of FIG. 2, respectively. The same components as those in the prior art are denoted by the same reference numerals in FIG. 1.

As shown in the figures, a main shelf 20 is installed in a storage space S defined within the interior of a refrigerator main body 1. The main shelf 20 is horizontally mounted in the storage space S and serves to divide the storage space S into upper and lower spaces. The main shelf 20 is shaped as a rectangular plate corresponding to a horizontal cross section of the storage space S. Storage articles are put on a top surface of the main shelf 20.

A pair of support skirts 22 is provided on a bottom surface of the main shelf 20. The support skirts 22 are formed lengthwise along a fore-and-aft direction of the main shelf 20 to be parallel with each other. As viewed from FIG. 1, the support skirts 22 are provided at a right end on the bottom surface of the main shelf 20 and at a position on the bottom surface of the main shelf 20 spaced apart by a predetermined distance leftward from the right end on the bottom surface of the main shelf 20.

The main shelf 20 is integrally formed with the support skirts 22. For example, the main shelf 20 and support skirts 22 can be integrally formed with each through the injection molding to have predetermined elasticity. The main shelf 20 and support skirts 22 are preferably made of a transparent or translucent material to transmit light emitted from a lighting apparatus (not shown) installed in the storage space S.

Although it is described in this embodiment that the support skirts 22 are provided on the bottom surface of the main shelf 20, the position of the support skirts 22 is not limited thereto. For example, the support skirts 22 may be installed directly on the ceiling of the storage space S.

As shown in detail in FIG. 5, a pair of guide slots 24 and 24' are formed on each of the support skirts 22. The guide slots 24 and 24' are formed on the support skirt 22 lengthwise in the front and rear direction. Hereinafter, one of the guide slots 24 and 24' provided at a front end of the support skirt 22 is referred to as the first guide slot 24, and the other of the guide slots 24 and 24' provided at a rear end of the support skirt 22 is referred to as the second guide slot 24'. The length of each of the guide slots 24 and 24' is identical with a distance by which a penetration portion 45 of a support link 40 to be described below is moved while a supplementary shelf 30 to be described below is being elevated or lowered.

Guide ribs 26 are provided on each of the support skirts 22. Each of the guide ribs 26 is formed lengthwise along an upper end of the guide slot 24 or 24' in the front and rear direction of the main shelf 20. The guide rib 26 protrudes inwardly and perpendicularly from an opposite inner surface of the support skirt 22 by a predetermined width.

The guide rib 26 guides a support guide portion 42 of the support link 40 while the supplementary shelf 30 is being elevated or lowered. Further, the guide rib 26 may prevent the support guide portion 42 of the support link 40 from being rotated more than a predetermined range. Thus, the supplementary shelf 30 can be prevented from being elevated and positioned above the main shelf 20.

Front ends of the guide ribs 26 further extend forwardly by a predetermined distance than those of the guide slots 24 and 24', respectively. Rear ends of the guide ribs 26 are spaced apart by a predetermined distance from those of the guide slots 24 and 24', respectively, and are positioned to the inside of the support skirts 22 which corresponds to the inside of the guide slots 24 and 24'.

Support ribs 27 are provided on each of the support skirts 22. Each of the support ribs 27 is formed lengthwise along a lower end of the guide slot 24 or 24' in the front and rear direction of the main shelf 20. Similar to the guide rib 26, the support rib 27 also protrudes inwardly and perpendicularly from an opposite inner surface of the support skirt 22 by a predetermined width.

The support rib 27 serve to support the support guide portion 42 of the support link 40 when the supplementary shelf 30 is accommodated just below the main shelf 20 between the support skirts 22. The support rib 27 has a length relatively shorter than the guide slot 24 or 24'. Front and rear ends of the support rib 27 are spaced apart by a predetermined distance rearward or forward from the front and rear ends of the guide slots 24 or 24', respectively, such that the support rib 27 can be positioned on the inner surface of the support skirt 22 within the inside of the guide slot 24 or 24'.

A catching projection 28 is provided on a front end of the support rib 27. Each of the catching projections 28 is formed by downward bending the ends of the support rib 27. The catching projection 28 serves to prevent the penetration portion 45 of the support link 40 from being moved rearward along the guide slot 24 or 24' until the supplementary shelf 30 is positioned on the same line as the guide slots 24 or 24'.

A stopper 29 is provided at a position on each of the support skirts 22 in front of each of the first guide slots 24. Two opposite stoppers 29 protrude inwardly from the opposite inner surfaces of the support skirts 22, respectively. Each of the stoppers 29 serves to restrict the support guide portion 42 of the Support link 40 from being rotated. In other words, if a force applied to the support link 40 by the stopper 29 is larger than a predetermined level, the support guide portion 42 of the support link 40 overrides the stopper 29 due to the elasticity of the support skirt 22 and then rotates toward the front of the support skirt 22.

The supplementary shelf 30 is installed within the interior of the storage space S below the main shelf 20. The supplementary shelf 30 is shaped as a rectangular plate, similar to the main shelf 20. At this time, the front and rear length of the supplementary shelf 30 is the same as that of the main shelf 20, whereas a right and left width of the supplementary shelf 30 is relatively smaller than a distance between the support skirts 22.

The supplementary shelf 30 is installed to movable up or down with respect to the main shelf 20. The supplementary shelf 30 may be selectively located either just below the main shelf 20 or at a lowered position spaced apart by a predetermined distance from the bottom surface of the main shelf 20, depending on whether the shelf 30 is in use or not. When the supplementary shelf 30 is located at the lowered position spaced apart from by the predetermined distance from the bottom surface of the main shelf 20, the storage articles are securely placed on the top surface of the supplementary shelf 30 in the same manner as the main shelf 20.

To this end, the supplementary shelf 30 may be elevated or lowered while being moved forward or rearward in the storage space S. The supplementary shelf 30 may also be moved forward or rearward in the storage space S in a state where it has been moved forward and then elevated in the storage space S. In other words, when it is not necessary to utilize the supplementary shelf 30, the supplementary shelf 30 is moved rearward and then accommodated at a position just below the main shelf 20 in a state where it has been moved forward and then elevated in the storage space S. If it is necessary to utilize the supplementary shelf 30, the supplementary shelf 30 accommodated at the position just below the main shelf 20 is moved forward in the storage space S, and is then lowered while being moved rearward in the storage space S to be withdrawn, whereby the supplementary shelf 30 is located at the lowered position spaced apart by the predetermined distance from the bottom surface of the main shelf 20.

A plurality of link holders 32 are installed on the bottom surface of the supplementary shelf 30. The link holders 32 are provided at positions near front and rear ends on the bottom surface of the supplementary shelf 30, respectively. The rear link holders 32 are spaced apart by the length of the support guide portion 42 of the support link 40 from the front link holders 32 and the rear end on the bottom surface of the supplementary shelf 30.

Each of the link holders 32 is shaped as a ring. The link holder 32 is partially opened to form an entrance 33. The entrance 33 of the link holder 32 is inclined rearward. In this embodiment, the entrance 33 of each link holder 32 is inclined rearward at 45 degrees. The connection portion 41 of each support link 40 is rotatably fitted to the link holder 32 through the entrance 33.

A plurality of communication holes 34 are bored through the supplementary shelf 30. The communication holes 34 serve to allow cold air circulating within the storage space S to smoothly flow upward and downward through the supplementary shelf 30.

The pair of support links 40 are provided to allow the supplementary shelf 30 to be supported on and moved up or down with respect to the main shelf 20. The support links 40 are relatively rotated with respect to the main and supplementary shelves 20 and 30 when the supplementary shelf 30 is elevated or lowered.

Each of the support links 40 is provided with the connection portion 41. The connection portion 41 is rotationally fitted to the corresponding link holders 32 to support the supplementary shelf 30. The connection portion 41 is formed lengthwise in a right and left direction. The connection portion 41 has such a length that is relatively smaller than the distance between the support skirts 22 but is relatively larger than the right and left width of the supplementary shelf 30.

The support guide portions 42 are provided at both ends of the connection portion 41, respectively. The support guide portions 42 extend in a direction perpendicular to the longitudinal direction of the connection portion 41 at both ends of the connection portion 41, respectively. For example, the connection portion 41 and support guide portions 42 thereof may be formed by bending an elongated rod perpendicularly at both ends thereof.

The support guide portions 42 guide the up or down motion of the supplementary shelf 30. Further, the support guide portions 42 serve to support the supplementary shelf 30 accommodated at the position just below the main shelf 20. To this end, the support guide portions 42 are guided by the guide ribs 26 when the supplementary shelf 30 is accommodated or withdrawn as it is elevated or lowered while being moved forward or rearward in the storage space S. If the supplementary shelf 30 is accommodated at the position just below the main shelf 20 between the support skirts 22, the support guide portions 42 are supported by the support ribs 27.

Each of the coupling portions 41 is provided with a pair of swing-resistant ribs 43. The swing-resistant ribs 43 serve to prevent the supplementary shelf 30 from moving rightward or leftward with respect to the connection portion 41. The pair of swing-resistant ribs 43 are spaced apart by a distance equal to a right and left width of the link holder 32. Each of the swing-resistant ribs 43 extends in a radial direction from an outer circumferential surface of the connection portion 41 at a position corresponding to the relevant link holder 32. In a state where the connection portion 41 is fitted into the link holder 32, two opposite surfaces of the pair of swing-resistant ribs 43 are brought into close contact with both lateral surfaces of the link holder 32, respectively.

As shown in detail in FIG. 6, the penetration portion 45 is provided on an end of the support guide portion 42, which corresponds to an opposite side of the connection portion 41. The penetration portion 45 extends far away from the end of the support guide portion 42 in parallel with the connection portion 41.

The penetration portions 45 penetrate the guide slots 24 and 24' and are then inserted into insertion holes 54 and 54' of a coupling link 50, respectively, which will be described later. The penetration portions 45 penetrate the guide slots 24 and 24' from the supplementary shelf 30 to the outside and are then inserted into the insertion holes 54 and 54' of the coupling link 50, respectively. When the supplementary shelf 30 is elevated or lowered, the penetration portions 45 are moved along the guide slots 24 and 24' in a state where they penetrate the guide slots 24 and 24'.

Further, an insertion hook 47 is provided on an end of each penetration portion 45. A pair of insertion hooks 47 spaced apart by a predetermined interval from each other are provided on the end of the penetration portion 45 such that they provide a predetermined elastic force. The insertion hooks 47 are elastically deformed when the penetration portions 45 penetrate the guide slots 24 and 24' and are then inserted into the insertion holes 54 and 54' of the coupling link 50. Thus, the insertion hook 47 may prevent the penetration portions 45 from being inadvertently detached in a state where the penetration portions 45 has penetrated the guide slots 24 and 24' and then been inserted into the insertion holes 54 of the coupling link 50.

A pair of the coupling links 50 are provided to allow the support links 40 to rotate together when the supplementary shelf 30 is elevated or lowered. As shown in detail in FIG. 7, partially opened rings 52 and 52' for the coupling with the penetration portions 45 are provided on both ends of the coupling link 50, respectively. One of the rings 52 and 52', which is provided on the right end of the coupling link 50 as viewed from FIG. 7, is referred to as the first ring 52, whereas the other of the connection opening rings 52 and 52', which is provided on the left end of the coupling link 50 as viewed from FIG. 7, is referred to as the second ring 52'.

The insertion holes 54 and 54' are defined by the rings 52 and 52', respectively. One of the insertion holes 54 and 54', which is defined by the first ring 52, is referred to as the first insertion hole 54, whereas the other of the insertion holes 54 and 54', which is defined by the second ring 52', is referred to as the second insertion hole 54'. Preferably, opened portions 55 and 55' of the insertion holes 54 and 54' are opened toward different directions. The reason is that the penetration portions 45 can be easily inserted into the insertion holes 54 and 54' and also prevented from being inadvertently detached in a state where the penetration portions 45 have been inserted into the insertion holes 54 and 54'. The opened portion 55 of the first insertion hole 54 is opened to be inclined upward at 45 degrees with respect to the longitudinal axis of the coupling link 50. The opened portion 55' of the second insertion hole 54' is opened downward to be perpendicular to the longitudinal axis of the coupling link 50.

The coupling links 50 are installed on outer surfaces of the support skirts 22, respectively, opposite to the inner surfaces on which the guide ribs 26 and the support ribs 27 are formed. Thus, the penetration portions 45 are rotatably inserted into the insertion holes 54 and 54' through the opened portions 55 and 55', respectively, after penetrating the guide slots 24 and 24', Hereinafter, the operation of the supplementary shelf assembly for the refrigerator according to the preferred embodiment of the present invention so configured will be described.

First, a process of assembling the preferred embodiment of the supplementary shelf according to the present invention will be described with reference to FIG. 3.

The supplementary shelf assembly of the present invention is assembled in such a manner that the support links 40 are first coupled to the supplementary shelf 30 and then to the main shelf 20. By coupling the coupling links 50 to the support links 40 to which the main shelf 20 and the supplementary shelf 30 have been coupled as described above, the assembling process can be completed. The coupling sequence of the support links 40 with the supplementary shelf 30 and the main shelf 20 may be reversed. That is, the support links 40 may be first coupled to the main shelf 20 and then to the supplementary shelf 30.

More specifically, each of the connection portions 41 of the support links 40 is first inserted into the corresponding link holders 32 of the supplementary shelf 30. At this time, the connection portion 41 of the support link 40 is fitted to the link holders 32 through the entrances 33. In a state where the connection portion 41 of the support link 40 has been fitted to the link holders 32, the swing-resistant ribs 43 formed on the connection portion 41 of the support link 40 are brought into close contact with the lateral surfaces of the link holders such that the supplementary shelf 30 can be prevented from moving rightward or leftward with respect to the support links 40.

Then, the penetration portions 45 of each support link 40 are moved to penetrate the guide slots 24 and 24' from the inside of the main shelf 20 to the outside, respectively. At this time, the right and left length of the support links 40, i.e. the distance between the penetration portions 45, is relatively larger than the distance between the inner surfaces of the support skirts 22 through which the guide slots 24 and 24' are formed.

Thus, the penetration portion 45 of the support link 40 is moved to the main shelf 20 and then penetrates the guide slots 24 or 24' in a state where the connection portion 41 of the support link 40 is tilted by a predetermined angle respect to the front surface of the main shelf 20. That is, one of the penetration portions 45 of each connection portion 41 penetrates a front end of one of the first guide slots 24 (or the second guide slots 24') while the other of the penetration portions 45 of the connection portion 41 penetrates a rear end of the other of the first guide slots 24 (or the second guide slots 24').

In a state where the penetration portions 45 of the support links 40 penetrate the guide slots 24 and 24', respectively, the support links 40 and the supplementary shelf 30 coupled with the support links 40 are rotated such that the front surface of the supplementary shelf 30 and the connection portions 41 of the support links 40 are parallel with the front surface of the main shelf 20. Thus, the relative positions of the penetration portions 45 of the support links 40 with respect to the guide slots 24 and 24' are identical with each other.

Then, the penetration portions 45 of the support links 40 which have penetrated the guide slots 24 and 24' are inserted into the insertion holes 54 and 54' of the rings 52 of the coupling links 50, respectively, so that the assembling process of the supplementary shelf assembly according to the present invention can be completed. At this time, the penetration portions 45 of the support links 40, which have penetrated one of the guide slots 24 and 24', preferably the second guide slot 24', are first inserted into the first insertion hole 54 of the first ring 52. Then, in such a state, the penetration portions 45 of the support links 40, which have penetrated the other of the guide slots 24 and 24', i.e. the first guide slot 24, are inserted into the second insertion hole 54' of the second ring 52'.

Hereinafter, the process of operating the preferred embodiment of the supplementary shelf assembly for the refrigerator according to the present invention will be described in detail with reference to the accompanying drawings.

Figure 8:
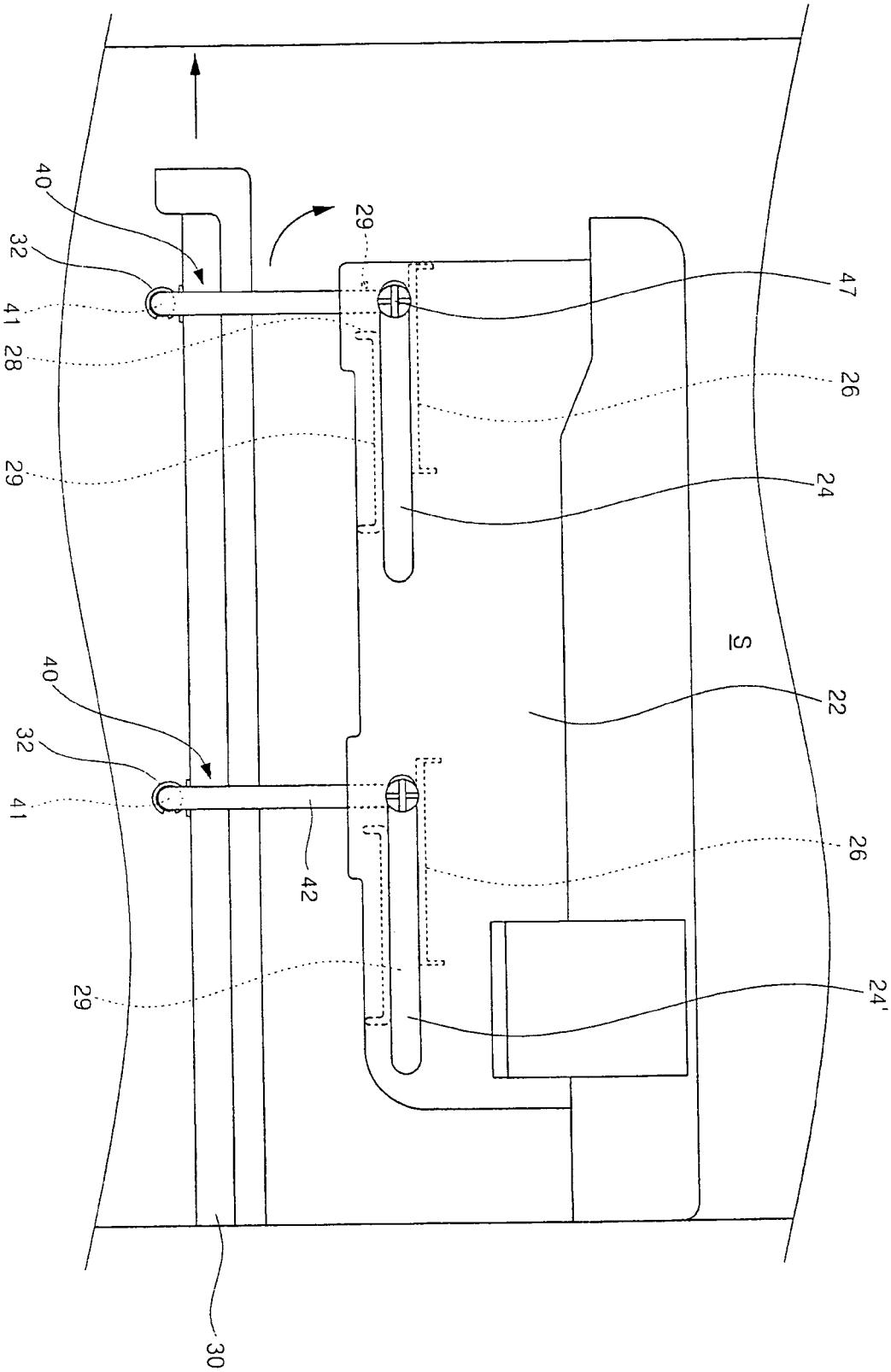
FIGS. 8 to 10 show operating processes of the embodiment shown in FIG. 2.
Figure 9:
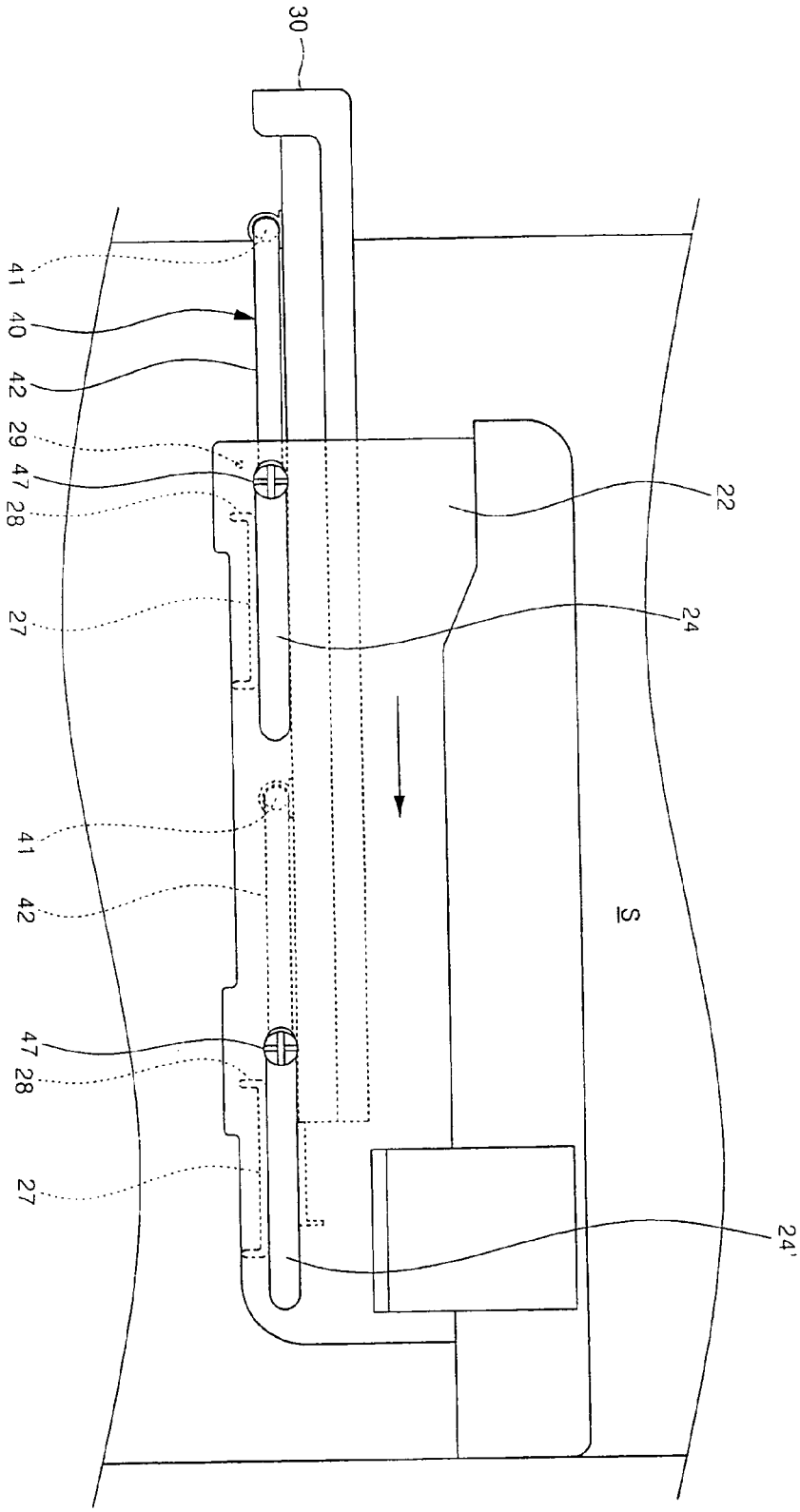
Figure 10:
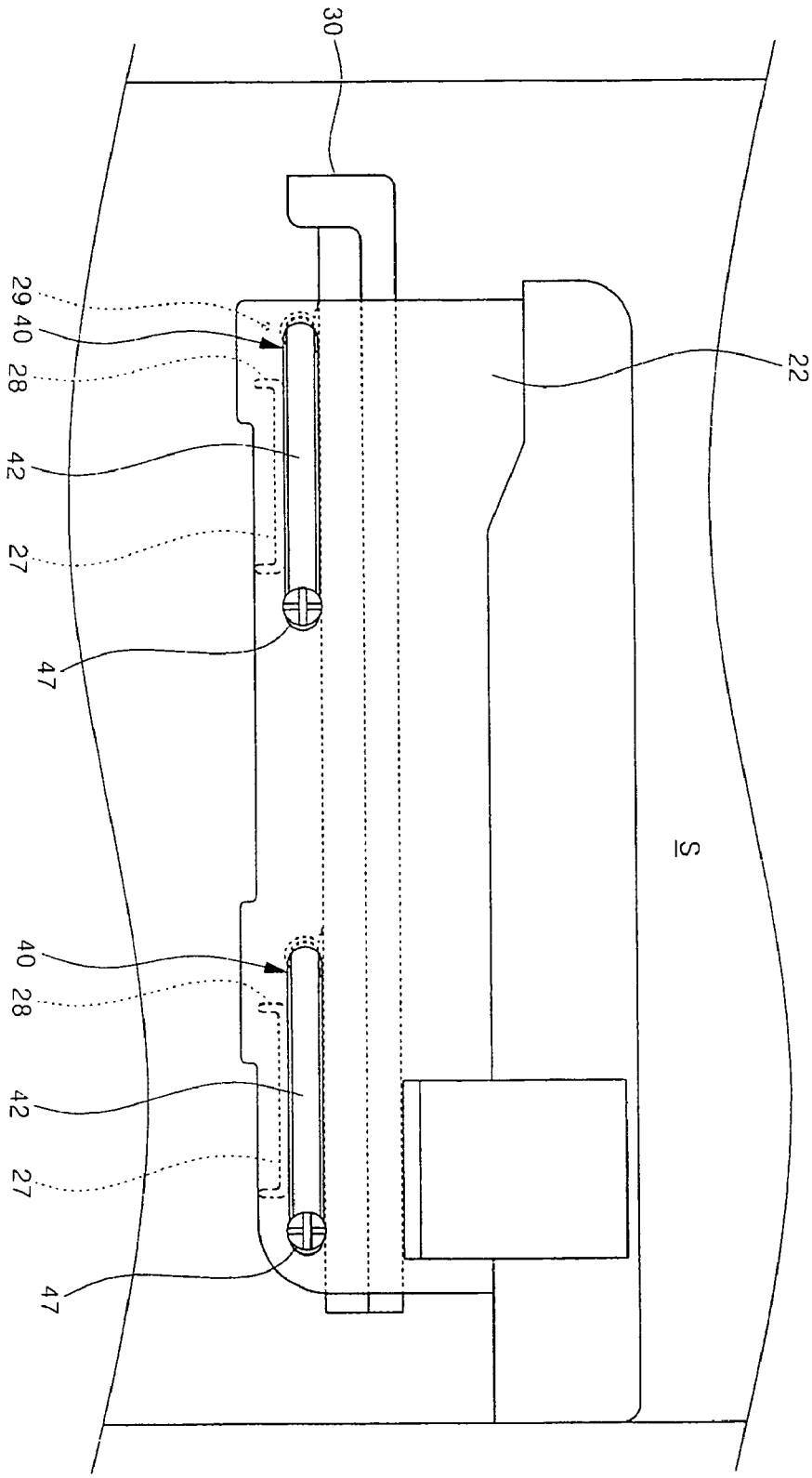

FIGS. 8 to 10 show the process of operating the preferred embodiment of the supplementary shelf assembly for the refrigerator according to the present invention.

First, as shown in FIG. 8, the main shelf 20 and the supplementary shelf 30 are provided in the storage space S of the refrigerator. When it is necessary to utilize both the main shelf 20 and the supplementary shelf 30, the supplementary shelf 30 is lowered from the bottom surface of the main shelf 20 by a predetermined distance. The main shelf 20 and the supplementary shelf 30 are in a horizontal state. The storage articles can be put on the top surfaces of the main and supplementary shelves 20 and 30.

At this time, the rear end of the supplementary shelf 30 is brought into close contact with the rear surface of the storage space S. Front sides of the support guide portions 42 of the support links 40 for connecting the main shelf 20 and the supplementary shelf 30 with each other are brought into close contact with the stoppers 29 formed on the support skirts 22. That is, the support guide portions 42 are prevented from being relatively rotated with respect to the main shelf 20 and the supplementary shelf 30. Thus, the supplementary shelf 30 with the storage articles placed on the top surface thereof is prevented from being elevated and lowered.

On the other hand, when it is not necessary to utilize the supplementary shelf 30, the supplementary shelf 30 is accommodated at a position just below the main shelf 20. For example, in a case where relatively tall storage articles are put on a top surface of another main shelf (not shown) located just below the supplementary shelf 30 or where the refrigerator is carried, the supplementary shelf 30 should be accommodated at the position just below the corresponding main shelf.

To this end, the supplementary shelf 30 is pulled forward from the storage space S, i.e. leftward as viewed from the figure, by a force greater than a predetermined level. If the supplementary shelf 30 is pulled forward from the storage space S with such a force, the support guide portions 42 of the support link 40 override the stoppers 29.

Thus, the supplementary shelf 30 is elevated while being moved forward of the storage space S. At this time, the connection portions 41 of the support links 40 are rotated clockwise, as viewed in the figure, about the penetration portions 45 of the support links 40. Further, the connection portions 41 and the penetration portions 45 of the support links 40 are relatively rotated with respect to the main and supplementary shelves 20 and 30, respectively.

If the supplementary shelf 30 continues to be pulled forward from the storage space S, the support guide portions 42 of the support links 40 are brought into close contact with bottom surfaces of the guide ribs 26, as shown in FIG. 9. Thus, the supplementary shelf 30 can be elevated no longer. At this time, the supplementary shelf 30 and the support guide portions 42 of the Support links 40 are positioned on the same line as the guide slots 24 and 24'.

Until the supplementary shelf 30 is elevated such that the supplementary shelf 30 and the support guide portions 42 of the support links 40 are positioned on the same line as the guide slots 24 and 24', the support guide portions 42 of the support links 40 are prevented from being moved rearward by the catching projections 28 formed on the front ends of the support ribs 27. Thus, the penetration portions 45 cannot be moved rearward along the guide slots 24 and 24' until the supplementary shelf 30 is completely elevated.

In such a state, the supplementary shelf 30 is pushed rightward as viewed in the figure, i.e. rearward into the storage space S. Thus, the support guide portions 42 of the support links 40 are slid rightward, as viewed from the figure, along the support ribs 27 in a state where they are placed on upper surfaces of the support ribs 27. The penetration portions 45 of the support links 40 are also slid rightward, as viewed from the figure, along the guide slots 24 and 24'.

If the supplementary shelf 30 continues to be pushed rearward into the storage space S, the supplementary shelf 30 is accommodated at a position just below the main shelf 20 between the support skirts 22, as shown in FIG. 10. At this time, since the support guide portions 42 of the support links 40 are seated and supported on the upper surfaces of the support ribs 27, the support links 40 cannot be inadvertently rotated counterclockwise as viewed from FIG. 10.

Meanwhile, in order to utilize the supplementary shelf 30 accommodated at the position just below the main shelf 20, the supplementary shelf 30 should be withdrawn. A process of withdrawing the supplementary shelf 30 is performed in the reverse order of the process of accommodating the supplementary shelf 30 at the position just below the main shelf 20. That is, the supplementary shelf 30 is pulled forward from the storage space S. At this time, the support guide portions 42 of the support links 40 are moved along the support ribs 27 and the penetration portions 45 of the support links 40 are moved along the guide slots 24 and 24'.

If the supplementary shelf 30 continues to be pulled forward from the storage space S, the support guide portions 42 of the support links 40 are moved along the support ribs 27 in a state where they are placed on the upper surfaces of the support ribs 27. Then, the support guide portions 42 are detached from the support ribs 27. Thus, the support links 40 can be allowed to rotate. The penetration portions 45 of the support links 40 are also moved along the guide slots 24 and 24' and positioned on the front ends of the guide slots 24 and 24'.

In such a state, if the force for pulling the supplementary shelf 30 forward from the storage space S is eliminated, the supplementary shelf 30 is lowered while being moved rearward in the storage space S by its own weight. At this time, the connection portions 41 of the support links 40 are rotated counterclockwise, as viewed from the figure, about the penetration portions 45 of the support links 40, respectively.

Meanwhile, if the supplementary shelf 30 is lowered while being moved rearward in the storage space S, the support guide portions 42 of the support links 40 are rotated counterclockwise as viewed from the figure, and rear sides of the support guide portions 42 are brought into contact with the stoppers 29. At this time, the support guide portions 42 of the support links 40 may either continue to rotate to override the stoppers 29 due to the weight of the supplementary shelf 30 or be caught to the stoppers 29. In a case where the support guide portions 42 of the support links 40 are caught to the stoppers 29, the supplementary shelf 30 is pushed rearward in the storage space S by a force larger than the predetermined level such that the support guide portions 42 of the support links 40 can override the stoppers 29.

Hereinafter, another embodiment of the supplementary shelf assembly for the refrigerator according to the present invention will be described with reference to the accompanying drawings.

Figure 11:
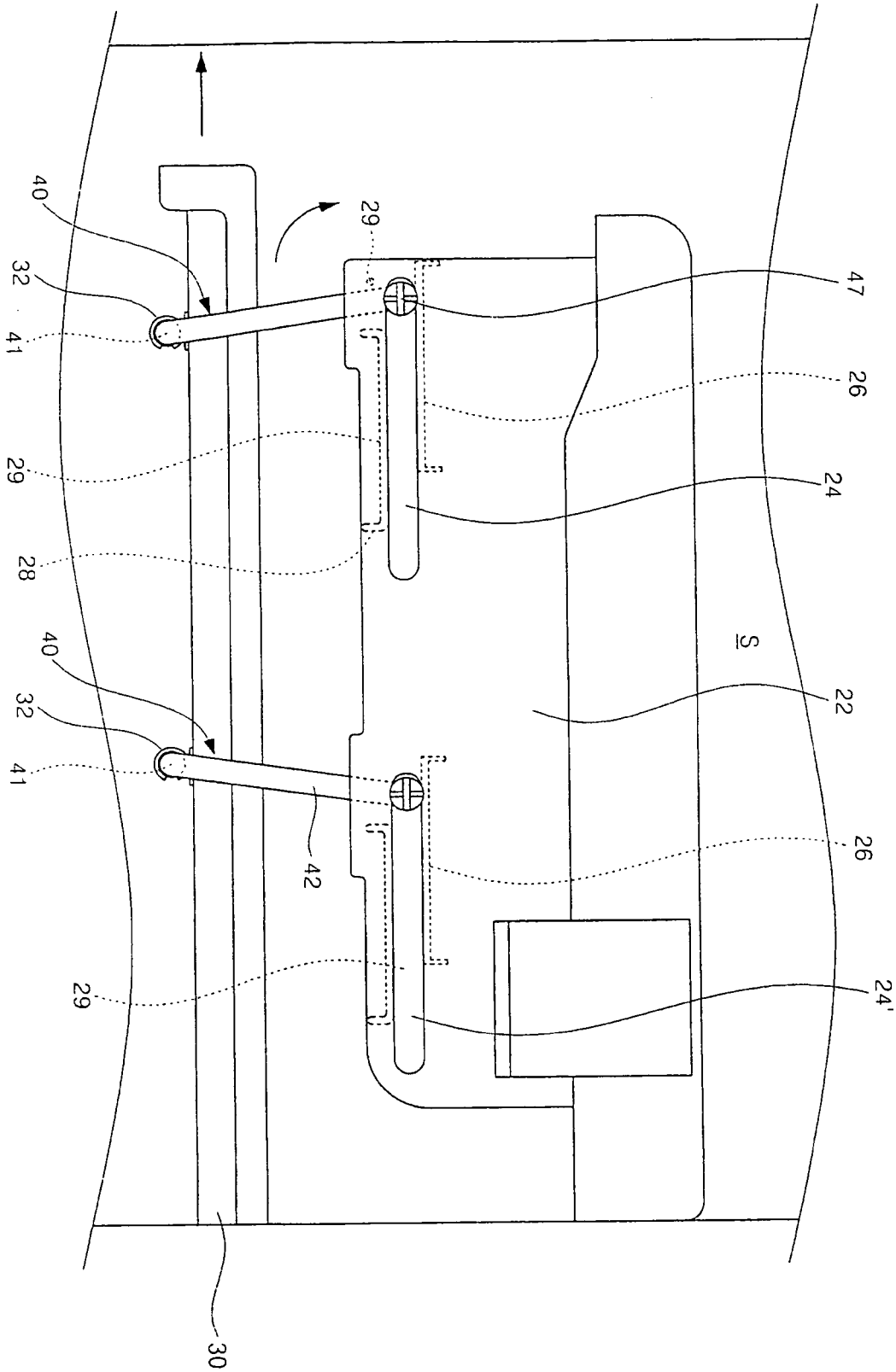
FIG. 11 is a side view showing another embodiment of the supplementary shelf assembly for the refrigerator according to the present invention.

FIG. 11 shows another embodiment of the supplementary shelf assembly for the refrigerator according to the present invention.

In the embodiment as shown in FIG. 11, a distance between the centers of the insertion holes 54 and 54' provided on both ends of each coupling link 50 is relatively larger than that between the centers of the link holders 32 provided on the bottom surface of the supplementary shelf 30. Thus, the supplementary shelf 30, the support guide portions 42 of the support links 40 and the coupling link 50 form a 4-link mechanism taking the shape of a reverse trapezoid. This prevents the supplementary shelf 30 from being freely swung at a position where the supplementary shelf 30 is lowered by a predetermined distance below the main shelf 20 such that the supplementary shelf 30 can be stably positioned. The other configurations of this embodiment are same as those of the previous embodiment shown in FIG. 2.

Although it has been described in the embodiments of FIGS. 2 and 11 that only a pair of support links are provided to support the supplementary shelf such that it can be elevated or lowered with respect to the main shelf, it is possible to provide more than one pair of support links according to the front and rear length of the supplementary shelf. It is also possible to provide more or less than one pair of link holders of the supplementary shelf according to the length of the connection portions 41 of the support links 40.

According to the supplementary shelf assembly for the refrigerator of the present invention as described above, the following advantages can be expected.

When the supplementary shelf is accommodated or withdrawn at a position just below the main shelf, the Support links for supporting the supplementary shelf with respect to the main shelf may be moved forward or rearward along the guide slots. Thus, even through the front and rear length of the supplementary shelf is identical with that of the main shelf, the supplementary shelf can be accommodated at the position just below the main shelf, and thus, the storage space can be more effectively utilized.

Further, the supplementary shelf is not inadvertently elevated, because the rear end of the supplementary shelf is brought into close contact with the rear surface of the storage space or the support links are prevented from being rotated by the stoppers provided on main shelf at least when storage articles are put on the top surface of the supplementary shelf. Thus, the operational reliability of the supplementary shelf can be achieved by the simpler configuration results.

In addition, the support links are connected to each other by means of the coupling link. Thus, since the supplementary shelf, the support links and the coupling link form a single link mechanism, the accommodation and withdrawal operations of the supplementary shelf can be performed in a regular manner. In particular, if the supplementary shelf, the support links and the coupling link form a 4-link mechanism taking the shape of a reverse trapezoid, the operational reliability or stability of the supplementary shelf can be further improved.

Furthermore, the opened portions of the rings provided on both ends of the coupling link are opened toward the different directions. Thus, the support links and the coupling link can be easily engaged with each other. Also, since the coupling links cannot be freely detached from the support links in a state where the support links and the coupling link are engaged with each other, the assembled status of the supplementary shelf assembly can be firmly achieved.

It will be apparent to those skilled in the art that various modifications and changes can be made thereto within the spirit and scope of the present invention. Therefore, it is obvious that the true scope of the present invention should be defined by the appended claims.

What is claimed is:

1. A supplementary shelf assembly for a refrigerator, comprising:

a pair of support skirts mounted on a ceiling of a storage space and formed with at least two guide slots in front and rear ends thereof;

at least two support links each of which includes a connection portion having a length relatively shorter than a distance between the support skirts, support guide portions extending perpendicular from both ends of the connection portion, respectively, and penetration portions extending outwardly and in parallel to the connection portions from ends of the support guide portions and penetrating the corresponding guide slots to be moved along the guide slots, respectively; and a supplementary shelf rotatably supported by the connection portions, and moved forward or rearward of the storage space and then elevated or lowered to be selectively located on a position near the ceiling of the storage space or on a position spaced apart by a predetermined interval from the ceiling of the storage space, wherein the guide slots have elongated shapes to allow the penetration portions to move between forward and rearward positions along the support skits when the supplementary shelf is elevated relative to the ceiling of the storage space, and wherein movement of the penetration portions in the guide slots causes the supplementary shelf to move by a proportional distance relative to the support skirts, and wherein link holders to which the connection portions are rotationally received are formed on the bottom surface of the supplementary shelf, and swing-resistant ribs brought into close contact with both sides of each of the link holders to prevent the supplementary shelf from being swung in a right and left direction are provided on the connection portion.

2. The supplementary shelf assembly as claimed in claim 1, wherein the ceiling of the storage space on which the support skirts are mounted is a bottom surface of a main shelf by which a storage space is divided into upper and lower spaces.

3. The supplementary shelf assembly as claimed in claim 2, wherein the supplementary shelf is moved forward or rearward with respect to the main shelf by a length of the support guide portion to be accommodated at or withdrawn from a position just below the main shelf between the support skirts in a state where the supplementary shelf is elevated.

4. The supplementary shelf assembly as claimed in claim 1, comprising:

wherein each of the support skirts includes:

guide ribs formed lengthwise along upper ends of the guide slots to restrict a rotation range of the support guide portions and also to guide motions of the support guide portions; and support ribs formed lengthwise along lower ends of the guide slots to support the support guide portions and to guide the motions of support guide portions in a state where the supplementary shelf is accommodated at the position just below a main shelf.

5. The supplementary shelf assembly as claimed in claim 4, wherein a distance between the guide slots is equal to the length of the support guide portion.

6. The supplementary shelf assembly as claimed in claim 5, wherein each of the support ribs is formed with a catching projection on a front end thereof to prevent the penetration portion from being moved along the guide slot until the supplementary shelf is elevated and the rotation of the support guide portion is then limited by the guide rib.

7. The supplementary shelf assembly as claimed in claim 6, wherein stoppers for restricting the rotation range of the support guide portions are formed on the support skirts at positions in front of the front ends of the guide slots.

8. The supplementary shelf assembly as claimed in claim 1, wherein at least two link holders are provided on each of the connection portions.

9. The supplementary shelf assembly as claimed in claim 8, wherein the link holders are formed at positions near front and rear ends on the bottom surface of the supplementary shelf, and the rear link holders are spaced apart by at least the length of the support guide portion from the front link holders and from the rear end on the bottom surface of the supplementary shelf.

10. The supplementary shelf assembly as claimed in claim 1, wherein the guide slots have substantially a same elongated shape.

11. A supplementary shelf assembly for a refrigerator, comprising a pair of support skirts mounted on a ceiling of a storage space and formed with at least two guide slots in front and rear ends thereof;

at least two support links each of which includes a connection portion having a length relatively shorter than a distance between the support skirts, support guide portions extending perpendicular from both ends of the connection portion, respectively, and penetration portions extending outwardly and in parallel to the connection portions from ends of the support guide portions and penetrating the corresponding guide slots to be moved along the guide slots, respectively;

a supplementary shelf rotatably supported by the connection portions, and moved forward or rearward of the storage space and then elevated or lowered to be selectively located on a position near the ceiling of the storage space or on a position spaced apart by a predetermined interval from the ceiling of the storage space; and coupling links having both ends rotatably coupled to the support links to allow the support links to be moved together.

12. The supplementary shelf assembly as claimed in claim 11, wherein partially opened rings with insertion holes are formed at both ends of the coupling link, respectively, and the penetration portions penetrate the corresponding guide slots and fitted into the insertion holes rings, respectively, so that the support links and the coupling link can be rotationally connected with each other.

13. The supplementary shelf assembly as claimed in claim 12, wherein the insertion hole of the ring formed on one end of the coupling link is opened toward the end of the coupling link to be inclined at a predetermined angle with respect to a longitudinal axis of the coupling link, and the insertion hole of the ring formed on the other end of the coupling link is opened downward to be perpendicular to the longitudinal axis of the coupling link.

14. The supplementary shelf assembly as claimed in claim 13, wherein the predetermined angle is 45 degrees.

15. The supplementary shelf assembly as claimed in claim 14, wherein a distance between the connection portions connected to the supplementary shelf is relatively shorter than a distance between the insertion hole of the rings of the coupling link.

* * * * *